US008371647B2

(12) United States Patent
Ripley

(10) Patent No.: US 8,371,647 B2
(45) Date of Patent: Feb. 12, 2013

(54) BLAST RESISTANT VEHICLE SEAT

(75) Inventor: Edward B. Ripley, Knoxville, TN (US)

(73) Assignee: Babcock & Wilcox Technical Services Y-12, LLC, Oak Ridge, TN (US)

( * ) Notice: Subject to any disclaimer, the term of this patent is extended or adjusted under 35 U.S.C. 154(b) by 147 days.

(21) Appl. No.: 12/952,326

(22) Filed: Nov. 23, 2010

(65) Prior Publication Data

US 2011/0126698 A1 Jun. 2, 2011

Related U.S. Application Data

(60) Provisional application No. 61/263,941, filed on Nov. 24, 2009.

(51) Int. Cl.

| | |
|---|---|
| ***B60N 2/42*** | (2006.01) |
| ***B60R 21/23*** | (2006.01) |
| ***B60R 21/231*** | (2006.01) |
| ***B60R 21/233*** | (2006.01) |
| ***B60R 21/26*** | (2006.01) |
| ***B60R 21/264*** | (2006.01) |

(52) U.S. Cl. ..... 297/216.1; 297/216.13; 297/216.15; 297/216.16; 296/68.1; 280/740; 280/741

(58) Field of Classification Search .... 297/216.1–216.2; 296/68.1; 89/36.11; 280/740, 741
See application file for complete search history.

(56) References Cited

U.S. PATENT DOCUMENTS

| | | | | |
|---|---|---|---|---|
| 5,791,597 | A * | 8/1998 | Knoll | 297/216.1 X |
| 6,179,380 | B1 | 1/2001 | Hoffman | |
| 6,189,969 | B1 * | 2/2001 | McLaughlin et al. | 297/216.14 |
| 6,682,141 | B2 * | 1/2004 | Reynolds et al. | 297/216.1 |
| 6,824,211 | B2 * | 11/2004 | Bayer et al. | 297/216.12 |
| 7,354,106 | B2 * | 4/2008 | Dennis | 297/216.17 |
| 7,415,806 | B2 * | 8/2008 | Davidson | 89/36.11 X |
| 8,033,600 | B2 * | 10/2011 | Reynolds et al. | 297/216.1 |
| 8,047,572 | B2 * | 11/2011 | Carter et al. | 297/216.1 X |
| 2003/0052519 | A1 * | 3/2003 | Reynolds et al. | 297/216.1 |
| 2004/0195029 | A1 * | 10/2004 | Feldman | 297/216.1 X |
| 2007/0096535 | A1 * | 5/2007 | Lundell et al. | 297/216.1 X |
| 2007/0132213 | A1 * | 6/2007 | Suzuki et al. | 297/216.1 X |

OTHER PUBLICATIONS http://defense-update.com/products/s/Suspended_Blast_Resistant_Seat.htm.
http://www.army-technology.com/contractors/noise/stratos/.
http://www.defensenews.com/osd_story.php?sh=VSDY&i=3589869.
http://www.globalseating.com/wp-content/uploads/2009/02/issa-report-08-02-16.pdf.

* cited by examiner

*Primary Examiner* — Rodney B White
(74) *Attorney, Agent, or Firm* — Michael J. Renner, Esq.; Luedeka Neely Group, P.C.

(57) ABSTRACT

Disclosed are various seats for vehicles particularly military vehicles that are susceptible to attack by road-bed explosive devices such as land mines or improvised explosive devices. The seats often have rigid seat shells and may include rigid bracing for rigidly securing the seat to the chassis of the vehicle. Typically embodiments include channels and particulate media such as sand disposed in the channels. A gas distribution system is generally employed to pump a gas through the channels and in some embodiments the gas is provided at a pressure sufficient to fluidize the particulate media when an occupant is sitting on the seat.

12 Claims, 2 Drawing Sheets

BLAST RESISTANT VEHICLE SEAT

CROSS REFERENCES TO RELATED APPLICATIONS

This patent application claims priority from and is related to U.S. Provisional Patent Application Ser. No. 61/263,941 filed 24 Nov. 2009, entitled: "Blast Resistant Vehicle Seat." Provisional Patent Application Ser. No. 61/263,941 is incorporated by reference in its entirety herein.

GOVERNMENT RIGHTS

The U.S. Government has rights to this invention pursuant to contract number DE-AC05-00OR22800 between the U.S. Department of Energy and Babcock & Wilcox Technical Services Y-12, LLC.

FIELD

This disclosure relates to the field of seats for vehicles. More particularly, this disclosure relates to vehicle seats for protecting a seat occupant from an explosive blast originating from a location beneath the seat, such as a blast from an improvised explosive device (IED) triggered by the vehicle passing over the IED.

BACKGROUND

Various vehicles such as cars, trucks, and airplanes, particularly military vehicles, are susceptible to attack by road-bed explosive devices such as land mines or IEDs that are triggered by passage of the vehicle over the explosive device. Various "Mine Resistant Ambush Protected (MRAP)" vehicle seats have been developed in attempts to protect seat occupants from such explosions. Typically such seats provide conventional padding (such as foam rubber). Unfortunately such padding may actually intensify injuries received by the seat occupant as a result of an explosion. For example, it has been observed that forces from an explosion can compress foam rubber in the seat. This causes the occupant's body to "bottom out" against the seat frame, potentially causing an initial injury. Then a subsequent decompression or rebounding of the foam propels the occupant off the seat (like from a trampoline) at an acceleration rate that results from a combination of the blast forces plus the foam decompression forces. This acceleration may cause the occupant to be violently thrust against occupant restraint devices (such as seat belts shoulder belts, and harnesses) thereby causing a further injury to the occupant. After the vehicle and occupant reach the apex of the upward trajectory, gravity pulls everything back to earth and the occupant again compresses the foam and the occupant may again bottom out against the seat frame causing yet another injury. As the foam again decompresses the occupant is again thrust upward. Although the amplitude of the upward/downward movement decreases in each cycle due to dissipation of the initial shock energy, the compression/decompression of the foam seat typically multiplies the extent of occupant's injury. What is needed therefore are vehicle seat designs that provide better protection for a seat occupant than what is provided by conventional foam seats when a vehicle experiences an explosion from a road-bed explosive device or when a vehicle experiences shock forces and vibration forces resulting from other causes.

SUMMARY

In one embodiment the present disclosure provides a seat for a vehicle. The seat includes a shell that has an orifice. There are a plurality of channels, and each channel has a first end that is disposed adjacent the shell and that is in fluid communication with the orifice. A gas source is provided for flowing a gas at a gas temperature and flow rate through the orifice. A portion of the gas flows into the first end of each channel and the portion of gas that flows into the first end of each channel is vented from a second end of each channel. Particulate media is disposed in each channel for exposure to the gas that flows into the first end of each channel. Also provided is a method of reducing injury to an occupant in a vehicle subjected to a shock force or vibration forces.

BRIEF DESCRIPTION OF THE DRAWINGS

Various advantages are apparent by reference to the detailed description in conjunction with the figures, wherein elements are not to scale so as to more clearly show the details, wherein like reference numbers indicate like elements throughout the several views, and wherein.

DETAILED DESCRIPTION

In the following detailed description of the preferred and other embodiments, reference is made to the accompanying drawings, which form a part hereof, and within which are shown by way of illustration the practice of specific embodiments of seats for vehicles. It is to be understood that other embodiments may be utilized, and that structural changes may be made and processes may vary in other embodiments.

Foam padding is commonly supplied as a component of a vehicle seat. However, as previously noted in the Background information presented herein, if the vehicle is subjected to an explosion from a road-bed explosive device (such as a land mine or an improvised explosive device) the occupant typically "bottoms out" against the seat, and in a foam seat a very small surface area of the occupant's body is subjected to a very localized force. A subsequent decompression (i.e., expansion) of the foam typically propels the occupant upward. Gravity then pulls the occupant back down against the seat, and the cycle repeats until all the energy from the explosion is absorbed. A similar phenomenon may occur to pilots when aircraft ejection seats are actuated. Such injuries to the occupant are generally referred to herein as a "seat compression injury." In addition to seat compression injuries, in extreme cases the seat may detach from its mounting and the occupant may be impelled against the interior of the body of the vehicle.

Reducing the risk of seat compression injury does not necessarily have to be at the expense of reduced occupant comfort in the seat. Much of the comfort factor provided by seat cushion foam is the result of its conformance to the contour of the person sitting in the seat, such that the weight of the occupant is distributed relatively evenly over a comparatively large surface area of the seat. Such a conformal seat is preferred for occupant comfort because it reduces the number of (and magnitude of) pressure concentration points experienced by the occupant. However, as described herein, there are alternatives to the use of seat cushion foam to provide a seat that conforms easily and quickly to the body shape of a passenger. Furthermore, in such alternatives the seat is substantially incompressible to any further extent, and that seat may significantly minimize seat compression injury resulting from an explosion of a road-bed explosive device under the vehicle. These types of seats are examples of blast resistant vehicle seats.

Figure 1:
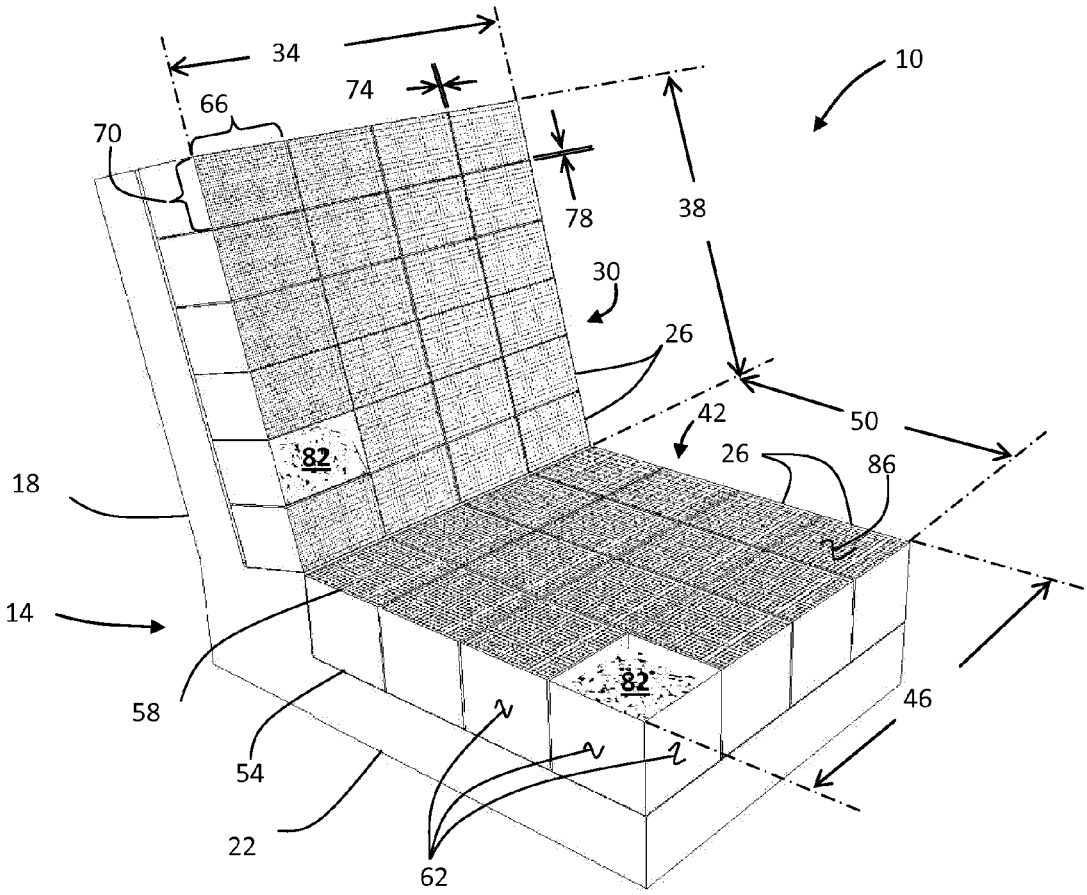
FIGS. 1, 2, and 3 depict various aspects and embodiments of seats for use in vehicles according to the disclosure.

One embodiment of a blast resistant vehicle seat embodying elements for minimizing seat compression injury is illustrated in FIG. 1 as seat 10. The seat 10 has a shell 14. In the embodiment of FIG. 1 the shell 14 is rigid. As used herein the term "rigid" refers to a material that cannot be folded or bent by manual manipulation without the use of tools. Typically the shell is formed from polymer material, but metals or composite materials may be employed. The shell 14 has a backrest portion 18 and a sitting portion 22. The seat 10 also has a plurality of channels 26 formed as hollow structures, typically tubular. A first portion of the channels 26 are disposed adjacent the backrest portion 18 of the shell 14 to form a backrest 30 having a backrest width 34 and a backrest height 38. In the embodiment of FIG. 1 the first portion of the channels 26 that form the backrest 30 includes twenty-four channels 26 that are configured as a four by six array. In other embodiments a different number of channels 26 may be used and the channels 26 may be configured in a differently-dimensioned array to form a backrest. A second portion of the channels 26 are disposed adjacent the sitting portion 22 of the shell 14 to form a seat cushion 42 having a seat cushion width 46 and a seat cushion depth 50. In the embodiment of FIG. 1 the second portion of the channels 26 that form the seat cushion 42 includes sixteen channels 26 that are configured as a four by four array. In other embodiments a different number of channels 26 may be used and the channels 26 may be configured in a differently-dimensioned array to form a seat cushion.

While the embodiment of FIG. 1 depicts a seat 10 having a backrest 30 disposed adjacent a backrest portion 18 of a shell 14 and a seat cushion 42 disposed adjacent a sitting portion 22 of a shell 14, other embodiments may utilize only a backrest 30 disposed adjacent a backrest portion 18 of a shell 14 or only a seat cushion 42 disposed adjacent a sitting portion 22 of a shell 14.

Each of the channels 26 has a first end 54 that is disposed adjacent the shell 14 and a second end 58 that is disposed distal from the first end 54. The channels 26 have sides 62. In the embodiment of FIG. 1 the sides 62 of the channels 26 are fabricated from polymeric material that is substantially non-porous, and the sides 62 are generally rectangular in shape and have a lateral expanse 66 and a longitudinal expanse 70 to form a hollow square tube. In other embodiments the sides 62 of the channels 26 may be fabricated from non-polymeric material such as rubber, silk, or other natural or synthetic fabric-like materials. In other embodiments the channels 26 may be formed from elements having a different shape, such as a circular side. The channels in those embodiments are shaped as hollow round tubes. Each channel 26 has a height 72.

In the embodiment of FIG. 1, the sides 62 of the channels 26 are spaced apart by a lateral separation distance 74 and by a longitudinal separation distance 78. In the embodiment of FIG. 1 each lateral separation distance 74 is less than about two percent of the backrest width 34 or the seat cushion width 46, and each longitudinal separation distance 78 is less than about two percent of the backrest height 38 or the seat cushion depth 50. In other words, in the embodiment of FIG. 1 the channels 26 are spaced quite closely together, such that the combined lateral expanses 66 of the channels 26 occupies about ninety-five percent of the backrest width 34 and about ninety-five percent of the seat cushion width 46. Also in the embodiment of FIG. 1 the combined longitudinal expanses 70 of the channels 26 occupies about ninety-five percent of the backrest height 38 and about ninety-five percent of the seat cushion depth 50.

In other embodiments the channels 26 may be significantly spaced apart, such that each lateral separation distance 74 is more than about five percent of the backrest width 34 or the seat cushion width 46 and each longitudinal separation distance 78 is more than about five percent of the backrest height 38 or the seat cushion depth 50. In these significantly spaced apart configurations for the channels 26, the combined lateral expanses 66 of the channels 26 may occupy less than about eighty-five percent of the backrest width 34 and less than about eighty-five percent seat cushion width 46. Furthermore in these spaced-apart embodiments, the combined longitudinal expanses 70 of the channels 26 may occupy less than about eighty-five percent of the backrest height 38 and less than about eighty-five percent of the seat cushion depth 50. The lateral separation distance 74 and the longitudinal separation distance 78 between the channels 26 need not be equal or uniform separation distances.

Typically each lateral separation distance 74 is less than about ten percent of the backrest width 34 or the seat cushion width 46 and each longitudinal separation distance 78 is less than about ten percent of the backrest height 38 or the seat cushion depth 50, and the combined lateral expanses 66 of the channels 26 occupy at least about sixty percent of the backrest width 34 and at least about sixty percent seat cushion width 46. Furthermore the combined longitudinal expanses 70 of the channels 26 typically occupy at least about sixty percent of the backrest height 38 and at least about sixty percent of the seat cushion depth 50. In the embodiment of FIG. 1 sides 62 of the channels 26 are formed from a pliant material. As used herein the term "pliant" refers to a material that can be folded or bent by manual manipulation without the use of tools, and after being so-manipulated, the material does not spring back to its previous geometric shape. Fabrics are examples of pliant materials. Typically the sides 62 of the channels 26 are formed from polymeric materials. In some embodiments the sides 62 of the channels 26 for a vehicle seat (such as the seat 10) may be fabricated from resilient materials. As used herein, the term "resilient" refers to a material that can be folded or bent by manual manipulation forces without the use of tools, but that is sufficiently stiff to spring back to its previous geometric shape when the manual manipulation forces are removed.

In the embodiment of FIG. 1 the channels 26 are at least partially filled with a particulate media 82. The particulate media 82 comprises loose granules of material. Typically each channel 26 is filled with about three inches particulate media 82 which generally fills the channel to about 75%-85% of its height 72. The particulate media 82 may be formed from synthetic materials such as polymers or the particulate media 82 may be formed from natural materials such as sand. In this regard, the particulate media 82 may provide additional protection to the occupant of the seat against explosive debris.

FIG. 1 illustrates that a porous material 86 is disposed across the second end 58 of each of the channels 26, except for two channels 26 where, in this view of the seat 10, the porous material 86 is not shown so that the particulate media 82 is visible.

Figure 2:
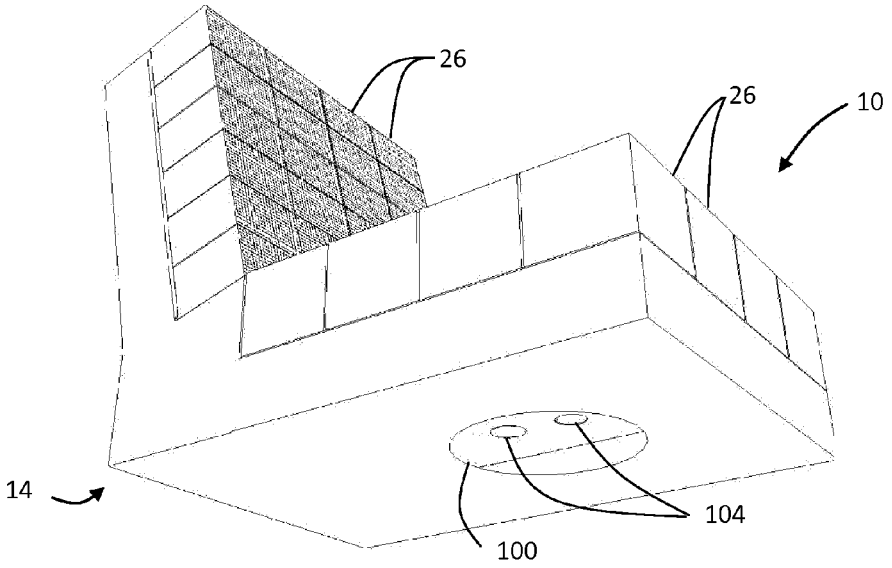

FIG. 2 illustrates a view of the seat 10 from below the seat 10. From this viewpoint an orifice 100 is visible in the shell 14. Passageways 104 provide for fluid communication between the orifice 100 and the channels 26. Elements such as appropriately-sized pores, porous materials, filters, screens, or traps may be used separately or in combination to prevent the particulate media 82 from flowing out of the channels 26 back into the passageways 104.

Figure 3:
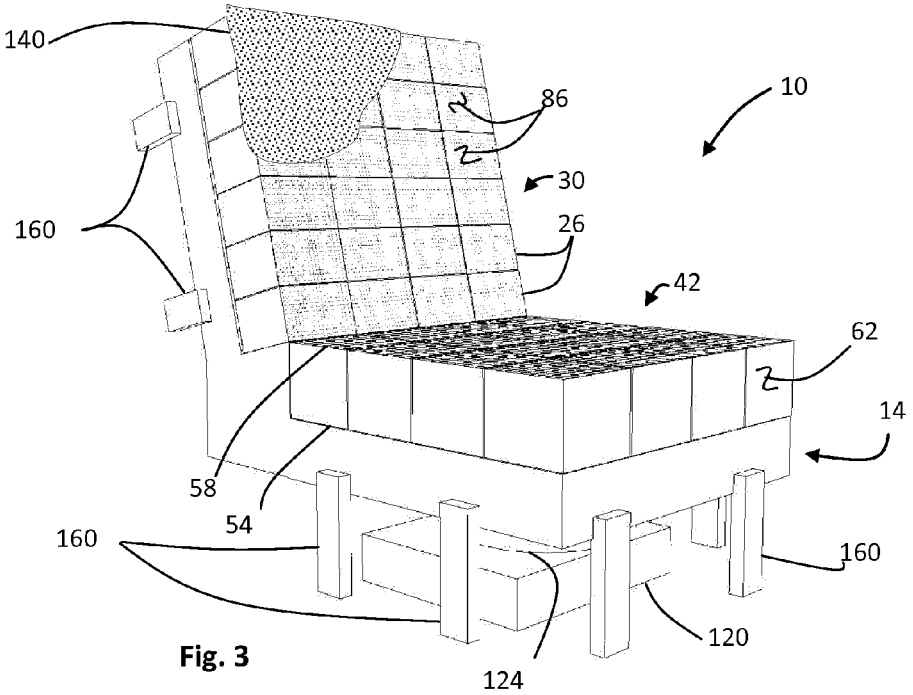

FIG. 3 illustrates how a gas source 120 may be combined for use with the seat 10. The gas source 120 is typically a compressor that forces a gas (typically air) at a gas flow rate into the orifice 100 (FIG. 2) of the shell 14 through a conduit 124. The gas flows through the passageways 104 (FIG. 2) in the shell 14 such that a portion of the gas enters a first opening in each of the first ends 54 of each channel 26 where it passes through the particulate media 82 (FIG. 1), and then is vented through the porous material 86 that is disposed across a second opening in the second end 58 of each of the channels 26. The conduit 124 and the second openings in the channels 26 allow for fluid communication between the channels 26 and the orifice 100. The particulate media 82 and the porous material 86 have an appropriate size and geometry to permit venting of the gas while preventing expulsion of the particulate media 82 from the channels 26. Other elements such as appropriately-sized pores, filters, screens, or traps may be added to the porous material 86 or used separately or in combination to permit venting of the gas while preventing expulsion of the particulate media 82 from the channels 26. Preferably the gas flow rate is sufficient to suspend the particulate media 82 in a fluidized state. The term "fluidized state" refers to a condition where the gas flows through the loose granules, which were disposed in a static heap, and lifts the granules of the particulate media 82 such that the granules are in a dynamic fluid-like state even under the weight of a person who is occupying the seat 10. The term "fluidizing" refers to a process whereby the granules are converted from a static state to a dynamic fluid-like state when a gas is passed through the granules.

In many embodiments the gas source 120 may comprise a heater or air conditioner or other thermal management device to heat or cool the gas to moderate the temperature of the backrest 30 and/or the seat cushion 42. In some embodiments a valve may be provided to direct heating or cooling to just the backrest 30, or to just the seat cushion 42, or to both the backrest 30 and the seat cushion 42. This heating and cooling may make occupancy of the seat 10 endurable, which might not be otherwise possible under extreme (very hot or very cold) environmental temperatures in which it may be desirable to operate the vehicle. In any case, the ability to thermally manage the passenger's thermal environment typically reduces fatigue and improves field endurance.

In some embodiments the backrest 30 of the seat 10 may be formed as a single channel having a lateral expanse that is substantially equal to the backrest width 34 depicted in FIG. 1 and having a longitudinal expanse that is substantially equal to the backrest height 38. In some embodiments the seat cushion 42 of the seat 10 may be formed as a single channel having a lateral expanse that is substantially equal to the seat cushion width 46 depicted in FIG. 1 and having a longitudinal expanse that is substantially equal to the seat cushion depth 50. In such embodiments where the backrest 30 and/or the seat cushion 42 of the seat 10 is formed as a single channel, multiple passageways 104 may be provided for fluid communication between the orifice 100 and such a single channel. Regardless of the number of channels utilized, such passageways 104 may be configured as a plurality of perforations for flowing gas from the gas source 120 into each channel.

In some embodiments a sheet material 140 (only a portion of which is shown in FIG. 3) may be disposed across the channels 26 such that the sheet material 140 is disposed adjacent the second ends 58 of the channels. This sheet material 140 typically is employed to enhance occupant comfort by such measures as reducing adhesion of the occupant's skin or clothing to the seat 10, wicking moisture away, providing ventilation, or providing warmth. The sheet material 140 may include light padding.

In many embodiments the gas source 120 provides gas at a pressure sufficiently high to "fluidize" the particulate media 82 (FIG. 1) that is disposed in the channels 26. As used herein the term "fluidize" refers to changing the granules from a static state to a dynamic fluid-like by passing a gas through the granules such that the particulate media 82 is suspended in the flow of the gas, even under the weight of a person who is occupying the seat 10. Preferably the gas source 120 is configured with a gas regulator such that the gas pressure may be regulated by the occupant in a range from zero pressure to a pressure that fluidizes the particulate media 82. This fluidizing facilitates a conforming of the shape of the backrest 30 and the seat cushion 42 to the contour of the body of the occupant plus any equipment or protective wear being worn by the occupant. That is, if the gas pressure from the gas source 120 is reduced to about zero, the channels 26 collapse under the weight of the occupant because of the previously-noted pliant material construction of the sides 62 of the channels 26. The porous material 86 and the particulate media 82 then conform to the contour of the occupant. The particulate media 82 is generally substantially incompressible when it is not fluidized. If the vehicle in which the seat 10 is installed is subjected to an explosion such as from a road-bed explosive device, this combination of conformance to the contour of the occupant and incompressibility spatially spreads the force exerted on the occupant of the seat 10. One way in which the seat 10 spatially spreads the force of an explosion is explained by analogy to what happens when a bag of sand is struck by a rapidly moving object. The bag distorts in a manner that moves sand laterally away from the direction of the blow. This lateral movement absorbs a significant portion of the energy of the blow. The seat 10 also spatially spreads the force of an explosion compared with a foam seat by causing the force to be applied over a larger surface area (i.e., the entire conforming contour of the occupant) compared with the previously-noted localized force experienced when the occupant bottoms out against a foam seat. This spatial spreading of the force greatly reduces the risk of previously-described seat compression injury.

In addition to spatially spreading the force applied to the occupant of the seat 10 when the vehicle in which the seat 10 is installed is subjected to an explosion from a roadbed explosive device, the seat 10 spreads the applied force over time, i.e., it effects a temporal spreading of the force. An explosion causes a very abrupt force to act upon the vehicle and the seat 10. One mechanism that acts to temporally spread the explosive force is compression of the fluidized (gas entrained) particulate media. That is, as the seat 10 is propelled toward the occupant, much of the gas in the fluidized channel 26 is expelled through the porous material 86. This expulsion of gas absorbs some of the energy from the explosion. A second mechanism that acts to temporally spread the explosive force is a beneficial inherent inefficiency of the particulate media 82 to transmit the explosive force. After most of the gas is expelled from the channels 26 the applied force is transmitted from particle to particle in the particulate media 82. This energy transfer takes far more time than transfer of such energy through a solid material. A third mechanism that acts to temporally spread the explosive force is that even when the particulate media 82 becomes nearly fully compacted, individual particles typically absorb further portions of the explosion energy by being displaced in a direction that is generally transverse to the initial force. This partial re-direction of the force reduces the spike impulse of the explosion and provides a reduced impact transfer. This energy absorption further delays the transfer of energy and also reduces the peak level of energy that is received by the vehicle occupant.

In some embodiments an interconnection passage may be provided between some or all of the channels 26 through adjacent sides 62. Such interconnection passage(s) permits fluid communication of gas from the gas source 120 between such interconnected channels. Such interconnection passage (s) may also permit transfer of portions of the particulate media 82 between interconnected channels 26. Such embodiments incorporating one or more interconnection passages may provide a seat having a softer feel for the occupant than embodiments that have fewer or no interconnection passages. As previously noted, each channel 26 is typically filled with about three inches of the particulate material 82, which fills the channel to about 75% to 85% of its height 72. In embodiments that employ fluid interconnection passages that permit transfer of portions of the particulate media 82 between adjacent channels 26, the amount of particulate media in some of the channels 26 may be decreased such that as little as one inch of filled particulate media may remain in some of the channels 26. This reduced amount of particulate media 82 typically still provides protection against seat compression injury and other injuries resulting from explosions from road-bed explosive devices.

FIG. 3 further illustrates a configuration where optional rigid bracing 160 has been added to the seat 10 so that the seat 10 can be rigidly secured to the chassis of a vehicle where it is deployed. The term chassis is used as in the conventional sense to refer to the framework that supports body and drive train of the vehicle, and to which the vehicle's wheels are mounted. Rigidly securing the seat 10 to the chassis of the vehicle is desirable to avoid separation of the seat 10 from its mounting relationship with the vehicle, thus preventing the occupant from being impelled against the interior of the body of the vehicle.

To summarize certain aspects of the Figures, various embodiments are depicted for a seat 10 for a vehicle. The seat 10 includes a shell 14 having an orifice 100. There are a plurality of channels 26, where each channel has a first end 54 that is in fluid communication with the orifice 100 (through, in this embodiment, the passages 104). There is a gas source 120 for flowing a gas at a gas temperature and a gas flow rate through the orifice 100. A portion of the gas flows into the first end 54 of each channel 26, and the portion of gas that flows into the first end 54 of each channel is vented from a second end 58 of each channel (in this embodiment through a porous material 86). Particulate media 82 is disposed for exposure to the gas that flows into the first end 54 of each channel 26.

In some embodiments a gas is directed into the channels 26 at a pressure sufficient to fluidize the particulate media 82 when an occupant is sitting on the seat 10. In such embodiments the fluidized particulate media will generally conform to the shape of the occupant. Then if the gas is turned off the particulate media 82 de-fluidizes. Anytime the occupant desires to change position the occupant may flow gas through the seat again to re-fluidize the seat. When the occupant is in a suitable occupancy position, the gas flow may be turned off.

A sheet material (e.g., 140 in FIG. 3) may be disposed adjacent the second ends 58 of the channels 26. Preferably the sheet material 140 comprises puncture-resistant and cut-resistant fabric. Light padding may be provided as a portion of the sheet material.

In some non-temperate geographic regions (such as deserts, equatorial latitudes and polar latitudes) the temperatures inside a vehicle without temperature conditioning may reach extremes that are detrimental to the performance of duties by the occupant of the seat. By passing chilled or heated gas through the channels 26 the temperature of the seat may be cooled or heated to avoid temperature extremes that would otherwise be experienced by the occupant of the seat.

In some embodiments the occupant's shoulders, neck, and back may also be supported with fluidized features, such as by the backrest 30 of the seat 10 depicted in FIG. 1. In this regard, the fluidized state of the media in the seat and other fluidized features associated with the seat can aid in reducing physiological pressure points exerted on the occupant of the seat. In addition to general discomfort, such pressure points can lead to serious health problems, such as deep vein thrombosis. The fluidized state of the media in the seat and other fluidized features may also help to smooth out the peaks and valleys of shock and/or vibration forces that are transmitted through the vehicle and act on the occupant of the seat. With respect to shock forces the term "smooth out" refers to reducing the magnitude of the force and potentially but not necessarily increasing the duration of the force. With respect to vibration forces, the term "smooth out" refers to reducing a difference between the amplitude of certain peaks and the amplitude of certain valleys of the vibration forces. In extreme combat conditions such shock forces may result from an explosion under the vehicle. In less extreme conditions such shock forces and vibration forces may occur just because of road roughness. Even these latter conditions can induce serious health problems, sometimes referred to as "vibration sickness," which may include bowel disorders and damage to the circulatory, musculoskeletal and neurological systems.

In summary, embodiments disclosed herein provide various configurations of vehicle seats. In some embodiments the seat is configured through rigid bracing to couple the occupant to the vehicle. Generally seats may be configured to conform easily to a wide variety of occupant torso shapes. Seats typically form a relatively solid seat. The temperature of gas flow through the seat may be adjustable to allow the occupant to heat or cool the backrest and/or seat cushion of a seat. In many embodiments the seat is configured to protect the occupant's body, shoulders, neck and back from injury resulting from the explosion of a road-bed explosive device under the vehicle. In most embodiments the seat may be reconfigured any time the occupant wants to shift or change position in the seat.

The foregoing descriptions of embodiments have been presented for purposes of illustration and exposition. They are not intended to be exhaustive or to limit the embodiments to the precise forms disclosed. Obvious modifications or variations are possible in light of the above teachings. The embodiments are chosen and described in an effort to provide the best illustrations of principles and practical applications, and to thereby enable one of ordinary skill in the art to utilize the various embodiments as described and with various modifications as are suited to the particular use contemplated. All such modifications and variations are within the scope of the appended claims when interpreted in accordance with the breadth to which they are fairly, legally, and equitably entitled.

What is claimed is:

1. A seat for a vehicle comprising:

a shell having an orifice;

at least one channel, each channel having a first end that is disposed adjacent the shell and that is in fluid communication with the orifice;

a gas source for flowing a gas at a gas temperature and a gas flow rate through the orifice wherein a portion of the gas flows into the first end of each channel and wherein the portion of gas that flows into the first end of each channel is vented from the seat through a second end of each channel; and particulate media disposed within each channel for exposure to the gas that flows into the first end of each channel.

2. The seat of claim 1 further comprising sheet material disposed adjacent the second end of each channel.

3. The seat of claim 1 wherein the gas flow rate is sufficient to suspend the particulate media in a fluidized state.

4. The seat of claim 1 further comprising a gas regulator to control the gas flow rate.

5. The seat of claim 1 further comprising a thermal management device to control the gas temperature.

6. The seat of claim 1 wherein the vehicle has a chassis and the seat further comprises rigid bracing for rigidly securing the seat to the chassis.

7. The seat of claim 1 comprising a plurality of channels.

8. A method of reducing injury to an occupant in a vehicle subjected to a shock force comprising fluidizing particulate media in a seat in which the occupant is seated, for temporal and spatial spreading of the shock force.

9. The method of claim 8 wherein the seat includes a channel having a first end and a second end, the method further comprising providing a gas flowing at a gas flow rate through the first end of the channel and vented from the seat through the second end of the channel, the gas flow rate being sufficient to fluidize the particulate media.

10. The method of claim 8 wherein the shock force is an explosive force resulting from a road-bed explosive device.

11. A method of reducing injury to an occupant in a moving vehicle subjected to vibration forces having a plurality of peaks and valleys of vibration force amplitudes comprising fluidizing particulate media in a seat in which the occupant is seated to reduce a difference between (a) the amplitude of a portion of the peaks and (b) the amplitude of a portion of valleys of the vibration force amplitudes.

12. The method of claim 1 wherein the second end of each channel includes a porous material sufficient to permit the venting of the portion of gas from the seat while preventing expulsion of the particulate media.

* * * * *